United States Patent [19]

Moertel

[11] 4,263,698

[45] Apr. 28, 1981

[54] MOLDED SLIDE FASTENER COUPLING ELEMENT

[75] Inventor: George B. Moertel, Conneautville, Pa.

[73] Assignee: Textron, Inc., Meadville, Pa.

[21] Appl. No.: 27,532

[22] Filed: Apr. 5, 1979

[51] Int. Cl.[3] ..... A44F 19/04

[52] U.S. Cl. ..... 24/205.13 R; 24/205.1 R

[58] Field of Search ..... 24/205, 13 R, 205.1 R, 24/205.12 R

[56] References Cited

U.S. PATENT DOCUMENTS

| | | | |
|---|---|---|---|
| 2,394,211 | 2/1946 | Siff | 24/205.13 R |
| 2,526,600 | 10/1950 | Bolten, Jr. | 24/205.13 R |
| 2,701,401 | 2/1955 | Dorman | 24/205.13 R X |
| 2,849,774 | 9/1958 | Ryser | 24/205.13 R |
| 2,959,833 | 11/1960 | Ryser | 24/205.13 R X |
| 3,110,947 | 11/1963 | Morin | 24/205.13 R X |
| 3,121,929 | 2/1964 | Morin | 24/205.13 R |
| 3,886,634 | 6/1975 | Murata | 24/205.13 R |
| 4,040,150 | 8/1977 | Fukuroi | 24/205.13 R |

FOREIGN PATENT DOCUMENTS

| | | | |
|---|---|---|---|
| 502364 | 4/1951 | Belgium | 24/205.13 |

*Primary Examiner*—Roy D. Frazier
*Assistant Examiner*—Peter A. Aschenbrenner
*Attorney, Agent, or Firm*—O'Brien and Marks

[57] ABSTRACT

Molded coupling elements are formed without draft in the locking portions, such as the locking protrusions, and are formed with double draft in passive portions, such as the neck area, to provide increased locking strength and operational clearance for slide fastener flexibility.

6 Claims, 5 Drawing Figures

FIG. 1
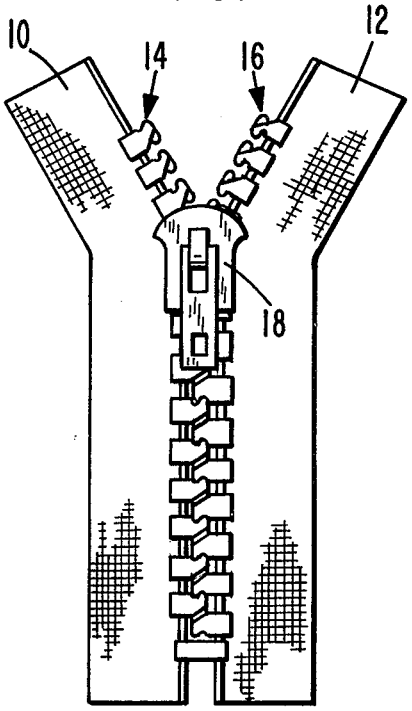
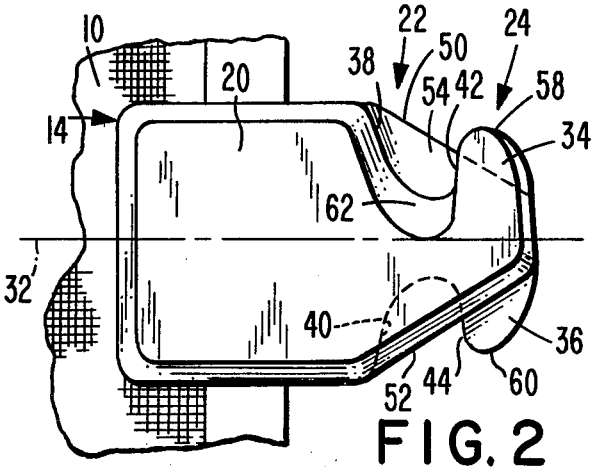
FIG. 2
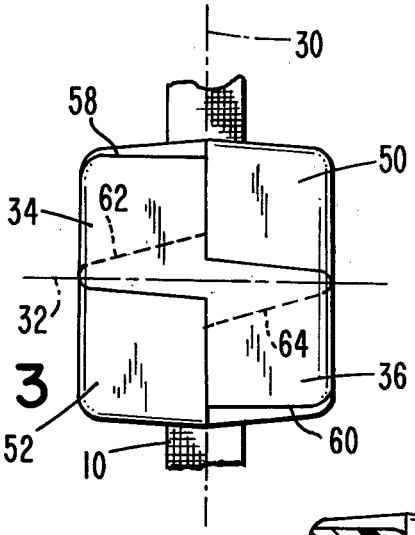
FIG. 3
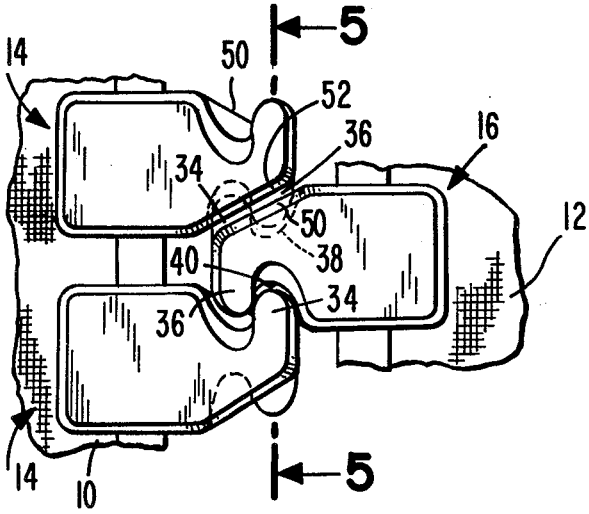
FIG. 4
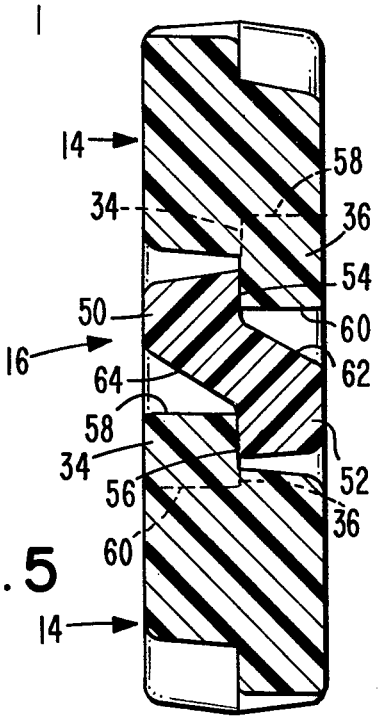
FIG. 5

MOLDED SLIDE FASTENER COUPLING ELEMENT

BACKGROUND OF THE INVENTION

1. Field of the Invention

This invention relates to coupling elements for slide fasteners, and particularly to molded coupling elements formed from polymeric resin materials, metal, or the like.

2. Description of the Prior Art

In the prior art, molded coupling elements are formed with draft or taper so that the elements are easily removed from the molding apparatus and also to provide for operational clearance and flexibility in the slide fastener. This draft in the prior art is also formed in the locking areas of the slide fastener which results in greatly reduced overlap or locking of the outer portions of the locking members of the coupling elements. Prior art molded slide fastener coupling elements are illustrated in U.S. Pats. No. 2,526,600, No. 2,849,774 and No. 3,121,929. The draft or taper formed in prior art molded coupling elements is particularly illustrated in FIG. 2 of the above U.S. Pat. No. 2,849,774.

SUMMARY OF THE INVENTION

The invention is summarized in a molded coupling element for a slide fastener, including a body or leg portion for being secured to an edge portion of one carrier tape of the slide fastener, a locking portion including a head portion and a neck portion extending from the body for interlocking with locking portions of mating coupling elements on an opposite carrier tape of the slide fastener, the head portion including locking protrusions having distal edges extending perpendicular to the one carrier tape for providing increased bearing area with mating locking protrusions of the mating coupling elements, and the neck portion having recesses for receiving the locking protrusions of the mating coupling elements and having inner surfaces defining inner boundaries of the recesses formed with a taper relative to a perpendicular to the one carrier tape to provide for working clearance and flexibility of the coupling element in the slide fastener.

An object of the invention is to construct a new and improved molded coupling element for slide fasteners.

Another object of the invention is to construct a molded slide fastener coupling element with increased head bearing area without decreasing flexibility.

It is also an object of the invention to design a molded coupling element which can be manufactured in smaller sizes than previous molded coupling elements.

An advantage of the present invention is that molded coupling elements may be made from softer and lesser expensive polymeric resin materials than prior art molded coupling elements.

Another advantage of the invention is that the aesthetic appeal of the invention is not substantially affected by the improved design.

One feature of the invention is that the bending performance or flexibility of a slide fastener with molded coupling elements is improved along with providing relatively greater crosswise strength of the slide fastener.

Other objects, advantages and features of the invention will be apparent from the following description of the preferred embodiment taken in conjunction with the accompanying drawings.

BRIEF DESCRIPTION OF THE DRAWINGS

FIG. 1 is a plan view of a slide fastener constructed in accordance with the invention.

FIG. 2 is an enlarged plan view of one molded coupling element secured on an inner edge portion of one carrier tape of the slide fastener of FIG. 1.

FIG. 3 is a side view taken from the right of the coupling element and tape portion of FIG. 2.

FIG. 4 is an enlarged plan view of a portion of the interengaged coupling elements of the slide fastener of FIG. 1.

FIG. 5 is a cross section view taken at line 5—5 in FIG. 4.

DESCRIPTION OF THE PREFERRED EMBODIMENT

As illustrated in FIG. 1, the invention is embodied in an elongated planar slide fastener, having a pair of carrier tapes 10 and 12 with respective rows of interengaging coupling elements indicated generally at 14 and 16 and mounted on the inner edges of the respective tapes 10 and 12. A slider 18 is slidably mounted on the rows of coupling elements 14 and 16 for opening and closing the slide fastener. The coupling elements are preferably molded from a molten polymeric material such as polyester, polyethylene, polypropylene or polyamide directly onto the tapes in a molding apparatus such as that described in my U.S. patent application, Ser. No. 826,542, filed Aug. 22, 1977. Alternately, the elements may be molded separate, using conventional apparatus and techniques; the elements being attached to the tapes in a separate conventional operation.

Each of the coupling elements 14, as illustrated in FIG. 2 include a body or leg portion 20 secured to the inner edge portion of the tape 10, a neck portion indicated generally at 22 and extending from the body portion 20, and a head portion indicated generally at 24 mounted on the neck portion 22. The head portion 24 and neck portion 22 form a locking portion of the slide fastener element 14 for interlocking with locking portions of a corresponding pair of adjacent coupling elements 16 on the tape 12.

Referring to FIG. 3, the locking portion of the coupling element 14 has four quadrants which are defined by a parallel center plane 30 and a perpendicular center plane 32. The parallel center plane 30 is illustrated as lying within the plane of the tape 10, or the slide fastener, while the perpendicular center plane 32 extends perpendicular to the longitudinal dimension of the slide fastener and the tape 10. One pair of diagonally opposite quadrants, namely the upper left quadrant and bottom right quadrant shown in FIG. 3, have locking protrusions 34 and 36 formed in the head portions 24 and have recesses 38 and 40, FIG. 2, formed in the neck portions 22. Bottom surfaces 42 and 44 of the locking protrusions 34 and 36 define the tops of the recesses 38 and 40. These bottom surfaces 42 and 44, beginning at the innermost region of the recess, extend at a slight incline away from the inner edge of the tape 10.

In the other pair of quadrants, namely the upper right quadrant and lower left quadrant shown in FIG. 3, the locking portion of the element 14 has respective guide or abutment portions 50 and 52. The abutment portion 50 has an inner surface 54 extending parallel or along the center plane 30 and forming a boundary portion of the recess 38. The abutment portion 52 has a similar inner surface 56, shown in FIG. 5, forming a boundary portion for the recess 40.

The distal edges 58 and 60 of the projections or protrusions 34 and 36 and the outer boundaries of the bottom surfaces 42 and 44 extend perpendicular to the parallel center plane 30. The innermost surface portions 62 and 64 forming the inner boundaries of the recesses 38 and 40 are formed with a substantial draft or taper; i.e., the surface 62 forms an obtuse angle with the surface 54 while the surface 64 forms a similar obtuse angle with the inner surface 56 of the abutment portion 52. This obtuse angle is selected to produce a draft which is about twice the normal angle employed for draft in conventional slide fasteners. For example the draft of the surfaces 62 and 64 is about 15° while the draft of the remaining surfaces, except for ends 58 and 60, is about 7°.

The abutment portions 50 and 52 extend from the body portions 20 to the top of the head portions 24. The outer surfaces of the abutment portion 50 and 52 converge toward the perpendicular center plane 32 progressing from the body portion 20 to the head portion 24.

The molded coupling elements 16 have a substantially similar shape in configuration to the coupling elements 14 so that the locking protrusions 34 and 36 and the recesses 38 and 40 on elements 16 will mate with the corresponding locking recesses and projections in the elements 14 as illustrated in FIG. 4.

As shown in FIG. 4 for the coupling elements 16, the locking protrusions 34 and 36 of an adjacent pair of coupling elements 14 are received within the respective recesses 40 and 38 of the element 16 with the bottom surfaces of the respective locking projections 34 and 36 of the element 16 bearing against the bottom surfaces of the respective projections 36 and 34 of the respective pair of coupling elements 14 to interlock the elements 14 and 16. As shown in FIG. 5, the inner surfaces 54 and 56 of the abutment members 50 and 52 of the element 16 engage the locking protrusions 36 and 34 of the respective corresponding pair of coupling elements 14 to hold the elements 14 and 16 together.

The elements 14 and 16 by having the distal edges 58 and 60 of their locking protrusions 34 and 36 extending perpendicular to the plane of slide fastener results in increased head bearing area between the coupling elements 14 and 16, as shown in FIG. 5. Operational clearance and flexibility in the slide fastener coupling elements is provided by rendering the surfaces 62 and 64 with a substantially greater draft or taper. Thus where the head coupling or bearing area is needed, the draft is eliminated, and draft is provided on the passive areas of the coupling elements, namely the neck portions 22 within the recesses 38 and 40 to provide for operational clearance and flexibility.

The provision of substantially greater head bearing areas, i.e., the overlapping areas of the locking protrusions 34 and 36 of the elements 14 and 16 results in substantial improvements in slide fasteners. The coupling elements can be manufactured in smaller sizes than is possible in the prior art since the larger bearing areas render the dimensions of the coupling elements less critical. Softer and less expensive polymeric resin materials may be used in forming the coupling elements due to the increased head bearing areas. Further, the particular design of the coupling elements with improved bearing areas does not affect the aesthetic appeal of the coupling element while providing for flexibility of the slide fastener and sufficient crosswise strength.

Since many variations, modifications and changes in detail may be made to the invention, it is intended that all matter described in the forgoing description and shown in the accompanying drawings be interpreted as illustrative and not in a limiting sense.

What is claimed is:

1. A molded coupling element for a slide fastener, comprising:

a body portion for being secured to an edge portion of one carrier tape of the slide fastener, a locking portion including a head portion and a neck portion extending from the body portion for interlocking with locking portions of mating coupling elements on an opposite carrier tape of the slide fastener, said body portion and said locking portion having a first center plane for extending in the one carrier tape and having a second center plane extending perpendicular to the first center plane and longitudinally through the body portion and the locking portion, said head portion including locking protrusions having distal edges extending perpendicular to the first center plane throughout lengths substantially from the center plane to outer edges of the locking portion for providing increased bearing area with mating locking protrusions of the mating coupling elements, and said neck portion of the locking portion having recesses for receiving the locking protrusions of the mating coupling elements and having innermost surfaces defining inner boundaries of the recesses formed with tapers from the first center plane toward the second plane through lengths extending substantially from the first center plane to outer edges of the locking portion to provide for working clearance and flexibility of the coupling element in the slide fastener.

2. A molded coupling element as claimed in claim 1 wherein the taper of the inner surface of the recesses is formed at an angle of about 15° relative to the second center plane.

3. A molded coupling element as claimed in claim 1 wherein the first and second center planes define quadrants of the locking portion, and the locking protrusions are a pair of locking protrusions extending from respective diagonally opposite quadrants of the quadrants of the locking portion of the coupling element, and there are included abutments extending from the body portion to top edges of the locking portions of the molded coupling elements in the respective other quadrants.

4. A molded fastening element for an elongated planar slide fastener comprising:

a body portion for being secured to one longitudinal edge portion of one carrier tape of the slide fastener, a locking portion extending from the body portion for interlocking with locking portions of mating fastening elements on an opposite carrier tape of the slide fastener, said locking portion having four quadrants defined by a parallel center plane and a perpendicular center plane, the parallel center plane being parallel to the plane of the slide fastener, and the perpendicular center plane being perpendicular to the longitudinal dimension of the slide fastener, said locking portion in one pair of diagonally opposite quadrants of the four quadrants thereof having respective locking protrusions with bottom surfaces for engaging bottom surfaces of locking protrusions on the mating fastening elements and having respective recesses bounded at tops thereof by bottom surfaces of the locking protrusions for receiving the locking protrusions of the mating fastening elements, said locking portion in the other pair of diagonally opposite quadrants of the four quadrants thereof having respective abutment members forming inside surfaces bordering the respective recesses on opposite sides of the parallel center plane and extending parallel the parallel center plane for engaging inside surfaces of the locking protrusions of the mating fastening elements, said locking protrusions in the one pair of quadrants having outer portions therof adjacent outer edges of the bottom surfaces thereof and extending parallel to the perpendicular center plane, and said locking portion in the one pair of quadrants having innermost surface portions thereof defining inner boundaries of the recesses and forming an obtuse angle with the inside surfaces of the abutment members.

5. A molded fastening element as claimed in claim 4 wherein the abutments extend from the body portion to a top of the locking portion and have outer surfaces which converge from the outer edges of the body portion toward the perpendicular center plane at the top of the locking portion.

6. A molded fastening element as claimed in claim 4 wherein the bottom surfaces of the locking protrusions beginning at innermost regions of the recesses extend at a slight incline away from the one longitudinal edge portion of the one tape.

* * * * *